US006039572A

United States Patent [19]

Meier et al.

[11] Patent Number: 6,039,572

[45] Date of Patent: Mar. 21, 2000

[54] FLOAT PLATFORM FOR AQUATIC INSTRUCTION AND THERAPY

[76] Inventors: William R. Meier; Maureen E. Meier, both of Star Rte. 62, Box 18B, Great Barrington, Mass. 01230

[21] Appl. No.: 09/179,772

[22] Filed: Oct. 27, 1998

[51] Int. Cl.[7] ..... A63B 69/12

[52] U.S. Cl. ..... 434/254; 441/130; 441/132

[58] Field of Search ..... 434/247, 254; 446/153, 160, 161; 482/1, 2, 3, 4, 5, 6, 7, 8, 9, 55, 901; 441/39, 125, 126, 129, 130, 132

[56] References Cited

U.S. PATENT DOCUMENTS

| | | | |
|---|---|---|---|
| 1,555,589 | 9/1925 | Lafarina | 441/132 |
| 1,562,276 | 11/1925 | Assenzio | 441/132 |
| 2,814,055 | 11/1957 | Burns | 9/21 |
| 2,980,927 | 4/1961 | Waters | 441/132 |
| 3,117,327 | 1/1964 | Mathew | 441/132 |
| 4,358,866 | 11/1982 | Rhodes | 114/363 |
| 4,650,432 | 3/1987 | Sainsbury | 441/35 |
| 5,360,360 | 11/1994 | Peterson | 441/130 |
| 5,439,405 | 8/1995 | Storey | 441/127 |
| 5,628,658 | 5/1997 | Clifford | 441/130 |

*Primary Examiner*—Robert A. Hafer
*Assistant Examiner*—Kurt Fernstrom
*Attorney, Agent, or Firm*—Malcolm J. Chisholm, Jr.

[57] ABSTRACT

The invention is a float platform for aquatic instruction and therapy for use in swim training facilities that includes three basic components, a frame and first and second flotation arms. The frame has a base platform with a first end wall, a second end wall and a back wall secured between the first and second end walls and extending above the base platform and cooperate to partially surround a user support area on the base platform. An unrestricted entry-exit is defined between the first and second end walls above a front edge of the base platform opposed to the back edge of the platform. The first and second flotation arms are detachably secured to top edges of the first and second end walls so that the top edges of the end walls float near a surface of the water above the base platform that is below the surface of the water, thereby enabling users on the support area to be partially supported above the surface of the water and enabling users to readily enter and exit the support area through the unrestricted entry-exit. In an alternative embodiment, the base platform may be secured at variable positions to the end walls and back wall to deploy the float platform in swim-training mode or a therapy mode.

17 Claims, 3 Drawing Sheets

FLOAT PLATFORM FOR AQUATIC INSTRUCTION AND THERAPY

BACKGROUND OF THE INVENTION

The present invention relates to apparatus for assisting persons in learning how to swim and how to use aquatic exercises for physical therapy and rehabilitation, and especially relates to flotation apparatus for those purposes.

It is well-known in modern swimming facilities such as swimming pools that the pools typically have a deep end and a shallow end. In pools used for competition swimming in particular, the shallow end is most often deep enough to allow swimmers to perform racing dives and competition turns, while the deep end is generally deep enough to permit competitive diving from spring diving boards above the pool. Frequently the shallow ends will be at least 3 feet from a pool bottom to a surface of water in the pool, while the deep ends will be 10 feet or greater.

When such pools are not being used for competition, it is common that they are used for both training young swimmers and for therapeutic or rehabilitative exercises for elderly or injured persons, such as the elderly overcoming hip fractures, strokes, etc. In fact, it is increasingly common for aquatic "aerobic" type exercise programs to be utilized for general conditioning without swimming (e.g., walking rapidly back and forth in a shallow end of the pool) because of the favorable impact on hip, knee and ankle joints, and the low probability of incurring injury to those joints during such exercise programs. Arthritis victims, and those recovering from injury may gain substantial cardiovascular—respiratory benefit from such aquatic exercise/therapy, non-swimming programs through vigorous movement of their arms and legs against the natural resistance of the water. Some persons utilizing aquatic therapy especially after substantial loss of leg function from for example a stroke or hip, knee, or ankle surgery are severely limited in the amount of stress their legs may withstand. Those persons may obtain valuable conditioning through use of their arms and gradual use of their legs while in a pool. However, they typically need an underwater support chair or overhead sling for an initial sitting type of position, or they require personal assistance for movement in the pool, until their legs have been rehabilitated to the point of being able to support them in an upright position in the water.

Training of young swimmers in pools having shallow and deep ends is increasingly popular amongst very young persons. It is not uncommon in modern American swim training programs to teach persons as young as 3–4 years old the fundamentals of stroke technique, as well as to accustom them to overcome a natural fear of the water. Infant swim-training programs are even known, wherein some children are taught to swim soon after they learn to walk.

A significant limitation on such young persons swim training programs and non-swimming aquatic therapy programs is that only a very limited portion of a pool having a deep end and a shallow end is available for the programs. Those portions of the pool over several feet, typically more than one-half of the pool, cannot be utilized for non-swimming aquatic therapy or young persons programs. Some modern pools are structured to have no "deep end" for diving, and have a uniform depth for swim training. However, such uniform-depth pools are designed to have typically about 4 feet from a pool bottom to a surface of the water, and that depth presents challenges to training very young swimmers that may be insecure where they have difficulty standing on the bottom with their heads well above the water. Even swimming pools with shallow ends of about 3 feet present security and training problems to very small swimmers. Such swimmers feel insecure where their heads are barely above the surface of the water, and those pools do not provide a stable support surface within the pool that enables such small swimmers to comfortably commence a swimming stroke.

Efforts to accommodate more small, young swimmers and/or more non-swimming aquatic therapy participants in known swimming pools include use of flotation apparatus such as "kick boards", or inflatable flotation devices. Both such apparatus, however, limit a person's ability to use their arms naturally, and therefore are a handicap in learning stroke technique. Additionally, those apparatus do not assist young swimmers in overcoming a fear of the water, as they become dependent upon the flotation apparatus. In pond or beach-front "camp" style swim areas, it is know to use raft, or wharf type structures that provide a standing or support surface at or near the surface of the water. Such structures have no practical utility within a pool environment, however, because they are not known to be readily removable or adaptable for practical storage while the pool is being utilized for competition swimming or diving.

Accordingly, there is a need for an apparatus that both enhances training of young swimmers and also assists persons performing non-swimming aquatic therapy within swimming pools or other swim training types of facilities.

SUMMARY OF THE INVENTION

A float platform for aquatic instruction and therapy is disclosed for use in swim training facilities for assisting training of young swimmers and for assisting persons using swim facilities for non-swimming aquatic therapy. In a preferred embodiment, the float platform includes three basic components, a frame and first and second flotation arms. The frame has a base platform with a first end wall secured to a first edge of the base platform, a second end wall secured to a second edge of the base platform and a back wall secured between the first and second end walls to a back edge of the base platform. The first and second end walls and the back wall extend above the base platform and cooperate to partially surround a user support area on the base platform having an unrestricted entry-exit between the first and second end walls above a front edge of the base platform opposed to the back edge of the platform. The first and second flotation arms are secured to top edges of the first and second end walls so that the top edges of the end walls float near a surface of the water above the base platform that is below the surface of the water, thereby enabling users on the support area to be partially supported above the surface of the water and enabling users to readily enter and exit the support area through the unrestricted entry-exit.

In a further preferred embodiment, the first and second flotation arms are readily detachable from the frame, the base platform is detachable from the end walls and back wall, and the end walls hinge to the back wall so that the float platform may be easily disassembled for ease of movement into and out of a swim facility and for ease of storage. In another embodiment, the base platform may be secured at variable positions to the end walls and back wall to deploy the float platform in swim-training mode or a therapy mode. In the swim training mode, the top edges of the end walls are about 2.5 feet from the base platform, and in the therapy mode the top edges of the end walls are about 1.5 feet above the base platform.

In use of the float platform, for example in the swim-training mode, the float platform may be readily assembled by a swim instructor within a swim facility such as a pool or pond-beach area. The float platform is dimensioned so that several young children may stand in the user support area. The instructor then instructs the children to dive or swim through the entry-exit for a few strokes, and to then return to the float platform. The float platform not only affords the children an island of security within an otherwise intimidating swim facility, but it also provides a superior training platform for instruction than either an edge or bottom surface of a pool. By being able to dive through the entry-exit, the young swimmer obtains momentum beneficial to learning stroke technique, without risks inherent in leaving a pool to dive back into the water. It is difficult for a 3–4 foot tall child to initiate a stroke from a standing position in a 3 foot pool, or from a position hanging onto a gutter or edge of a pool. The float platform dramatically facilitates training by providing the young swimmer with a comfortable, partially submerged user support area anywhere in a pool from which to start practicing a stroke. Several such platforms may be used within a swimming pool to increase useable areas of the pool.

In a therapy mode, the base platform of the frame is adjusted upward so that those persons seeking non-swimming aquatic therapy may readily sit on the user support area with their legs extending through the entry-exit. By kicking their legs and moving their arms against natural resistance of the water, the users receive therapeutic exercise benefits with no personal assistance, no risk to their joints, and virtually no risk of an aquatic accident. As in the swim-training mode, several float platforms may be used to enhance the capacity of the swim facility to provide safe aquatic therapy.

Accordingly, it is a general object of the present invention to provide a float platform for aquatic instruction and therapy that overcomes deficiencies of the prior art flotation apparatus.

It is a more specific object to provide a float platform that may be deployed in a swim-training mode and also in a therapy mode to facilitate both swim instruction and non-swim aquatic therapy.

It is yet another specific object to provide a float platform that may be easily disassembled into several components for ease of movement into and out of a swimming facility and for ease of storage.

The above and other objects and advantages of this invention will become more readily apparent when the following description is read in conjunction with the accompanying drawings.

DESCRIPTION OF THE PREFERRED EMBODIMENTS

Figure 1:
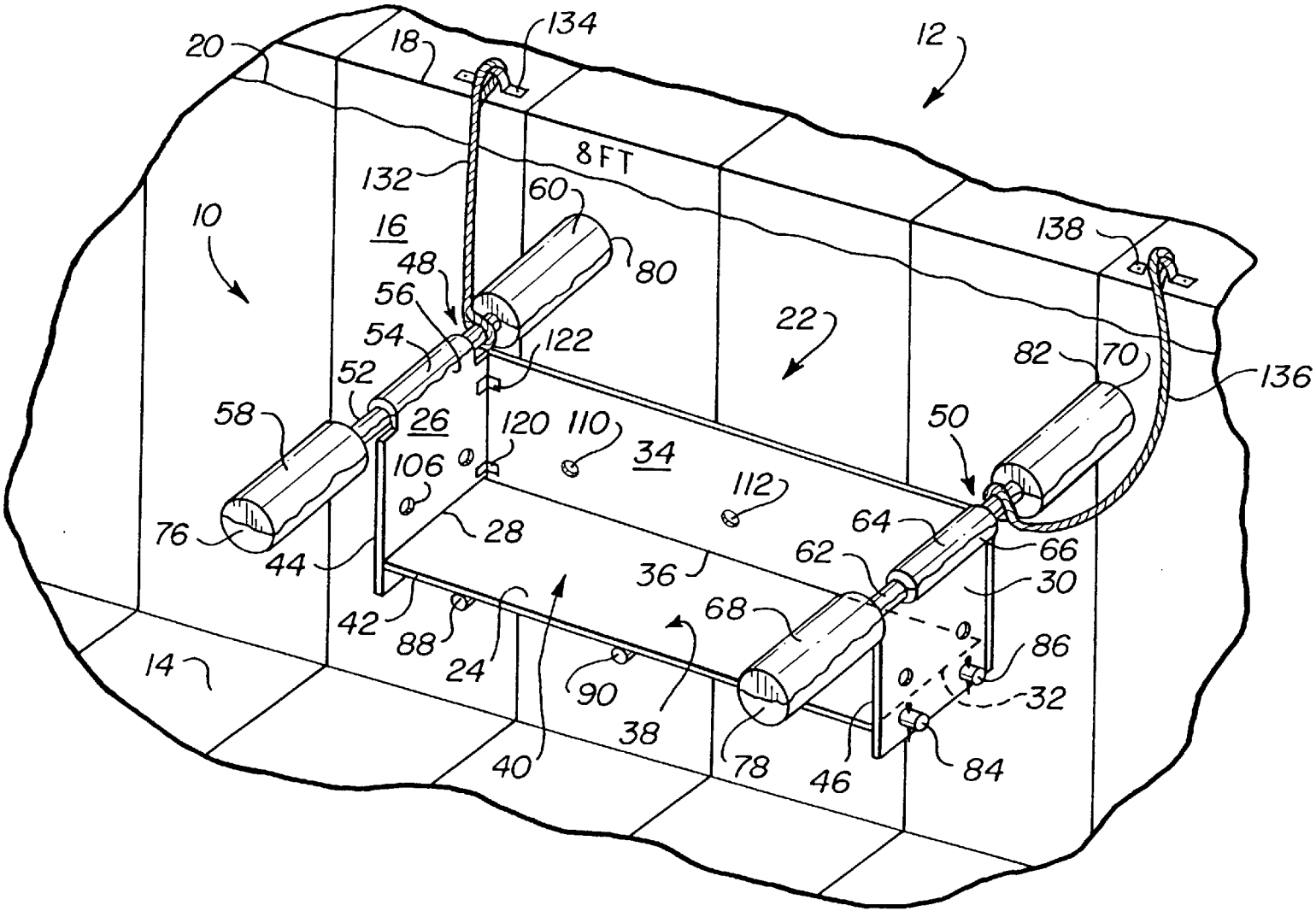
FIG. 1 is perspective view of a float platform for aquatic instruction and therapy of the present invention showing the float platform floating in a swimming pool.

Referring to the drawings in detail, a float platform for aquatic instruction and therapy of the present invention is best shown in FIG. 1, and is generally designated by the reference numeral 10. The float platform 10 in FIG. 1 is shown floating in standard swimming pool 12 a portion of which is shown in FIG. 1, having a bottom surface 14, a side 16 an upper edge 18, and showing a surface 20 of the water contained by the pool 12. The float platform 10 includes a frame 22 having a base platform 24 with a first end wall 26 secured to a first edge 28 of the base platform 24; a second end wall 30 secured to a second edge 32 of the base platform opposed to the first edge 28 of the base platform 24; and, a back wall 34 secured between the first and second end walls 26, 30 adjacent a back edge 36 of the base platform 24. The first and second end walls 26, 30 and back wall 34 extend above the base platform 24 and cooperate to define and partially surround a user support area 38 of the base platform 24 having an unrestricted entry-exit 40 of the frame 22 defined above a front edge 42 of the base platform 24 between a front edge 44 of the first end wall 26 and a front edge 46 of the second end wall 30.

The float platform 10 also includes a first flotation arm 48 and a second flotation arm 50. The first flotation arm 48 includes a first strut 52 dimensioned to be removably secured within a first strut hook 54 defined by a top edge 56 of the first end wall 26. The first flotation arm 48 also includes a first buoyancy body 58 and a second buoyancy body 60 secured to opposed ends of the first strut 52. Similarly, the second flotation 50 arm includes a second strut 62 dimensioned to be removably secured within a second strut hook 64 defined by a top edge 66 of the second end wall 30. The second flotation arm 50 includes a third buoyancy body 68 and a fourth buoyancy body 70 secured to opposed ends of the second strut 62. While the four buoyancy bodies 58, 60, 68, 70 are shown in FIGS. 1–5 as being cylindrical, it is to be understood that they may be in any shape appropriate for efficiently supporting the frame 22.

The frame 22 may be made of any of a variety of common materials suitable for supporting persons in standing or seating positions upon the support surface 38 of the base platform, such as modern plastics, or plastic coated wood materials, etc. A preferred construction would include modern plastics that have both structural strength for supporting loads as well as a density less than water for buoyancy, such as the plastics used to make modern "sail boards", "surf boards", etc. Components making up the frame do not have to be solid, planar materials. For example, the end walls 26, 30 may be made of a plurality of ribs or "fence-like" cross members held together by know joining mechanisms, while the base platform 24 is solid, or a combination thereof. The first and second struts 52, 62 of the first and second flotation arms 48, 50 would likewise be manufactured from known materials having adequate strength to support the load of the frame 22 such as tubular metals or plastics. The four buoyancy bodies 58, 60, 68, 70 may be fabricated of known flotation materials commonly used for example in United States Coast Guard approved "Personal Flotation Devices", such as a form of polystyrene frequently sold as "styrofoam".

Figure 2:
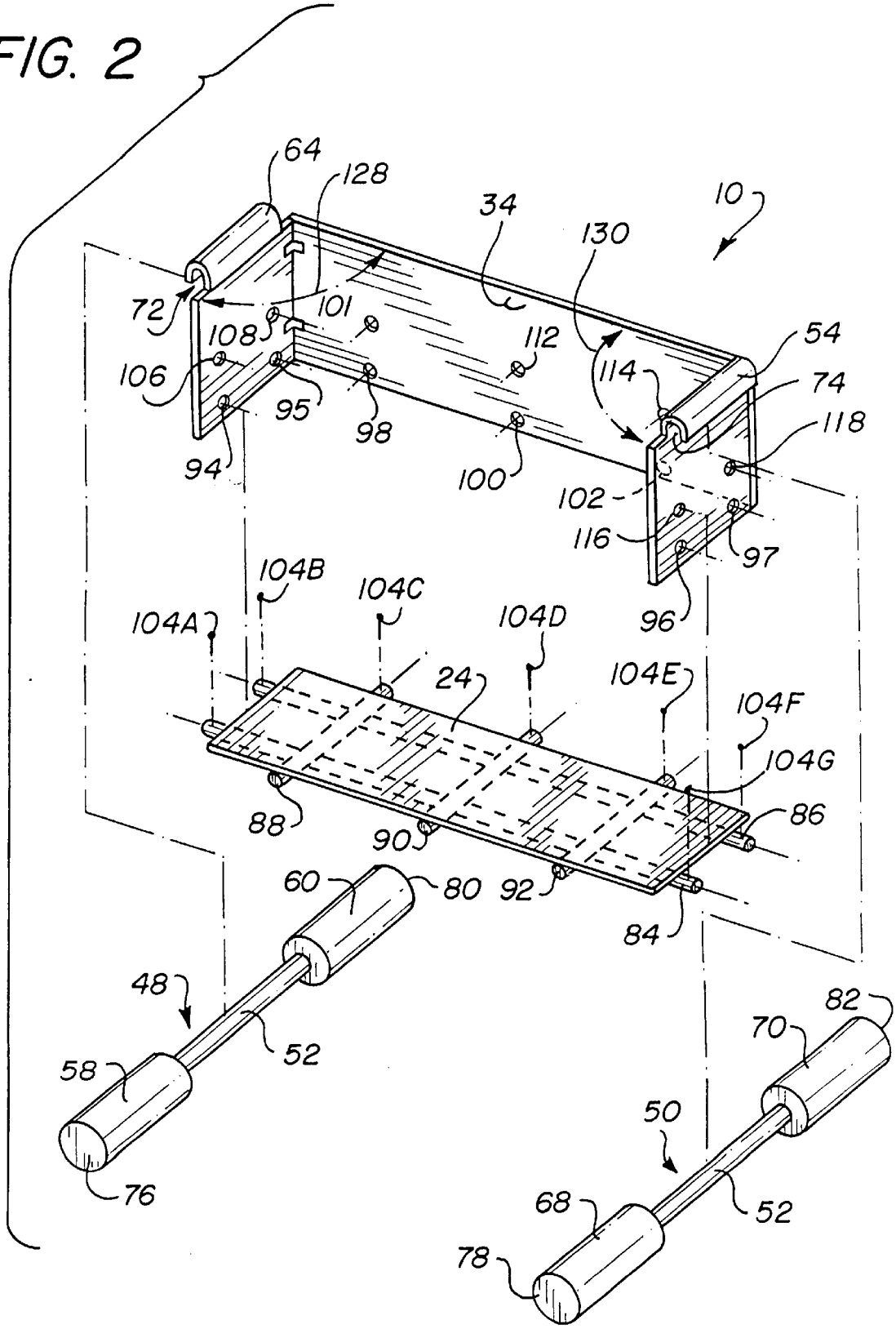
FIG. 2 is an exploded perspective view of the FIG. 1 float platform.
Figure 3:
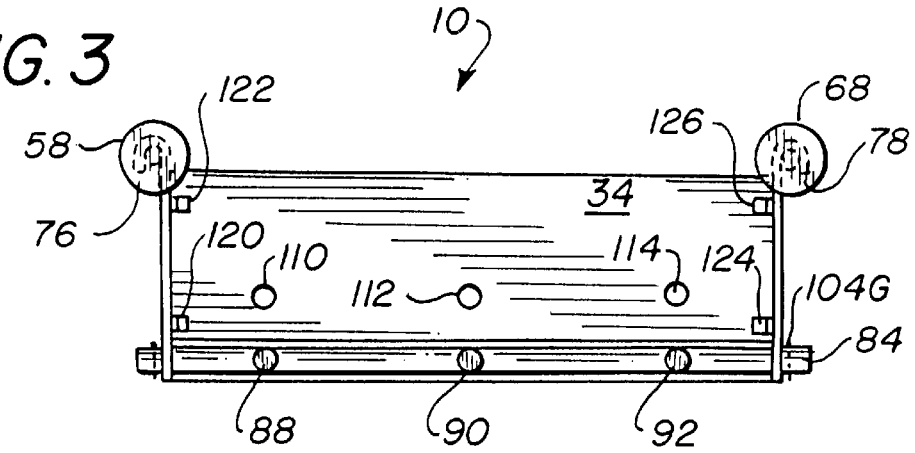
FIG. 3 is a front plan view of the FIG. 1 float platform.

The first and second flotation arms 48, 50 may be secured to the frame 22 by fastening means for securing the flotation arms to the frame above the base platform 24, such as being detachably secured by the first strut hook 54 and second strut hook 64 that are defined by the first and second top edges 56, 66 of the first end wall 26 and second end wall 30. As best shown in FIG. 2, the first and second strut hooks 54, 64 are simply hook-shaped formations of the first and second top edges 56, 66 of the first and second end wall 26, 30, wherein a diameter of an interior of each of the first and second strut hooks 54, 64 is approximately the same distance as a diameter of the first and second struts 52, 62 of the first and second flotation arms 48, 50, and a first opening 72 defined by the first strut hook 54 into the interior of the first strut hook 54 is a slightly shorter distance than the diameter of the first strut 52, and a second opening 74 defined by the second strut hook 64 into the interior of the second strut hook 62 is a slightly shorter distance than the diameter of the second strut 62 so that the first and second strut 52, 62 pass through the first and second openings 72, 74 by a slight elastic expansion of the openings and are detachably secured within the first and second strut hooks 54, 64 by elastic, compressive forces of the hooks. It is stressed that the fastening means for securing the first and second flotation arms to the frame may however include any of a variety of known means for securing an arm to a wall, including by way of example but not limitation, loop-shaped straps, rigid hooks with straps, defined throughbores to receive an elongate arm, permanent or semi-permanent (e.g., screws, bolts and nuts) securement between the arm and wall, a flotation arm permanently secured to a wall, etc.

Figure 4:
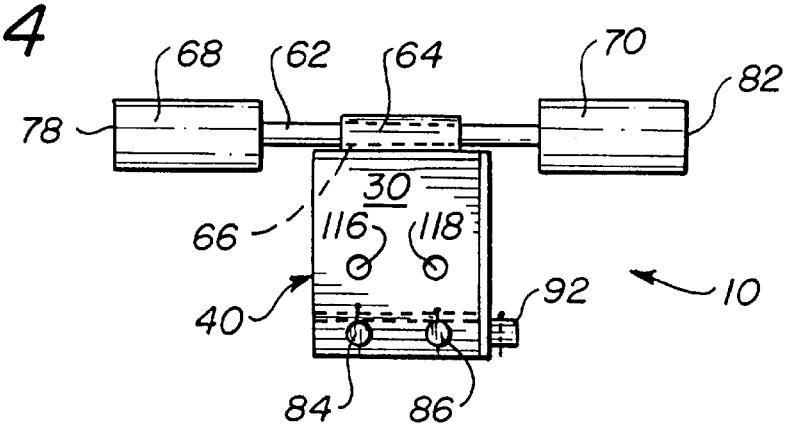
FIG. 4 is a side plan view of the FIG. 1 float platform.
Figure 5:
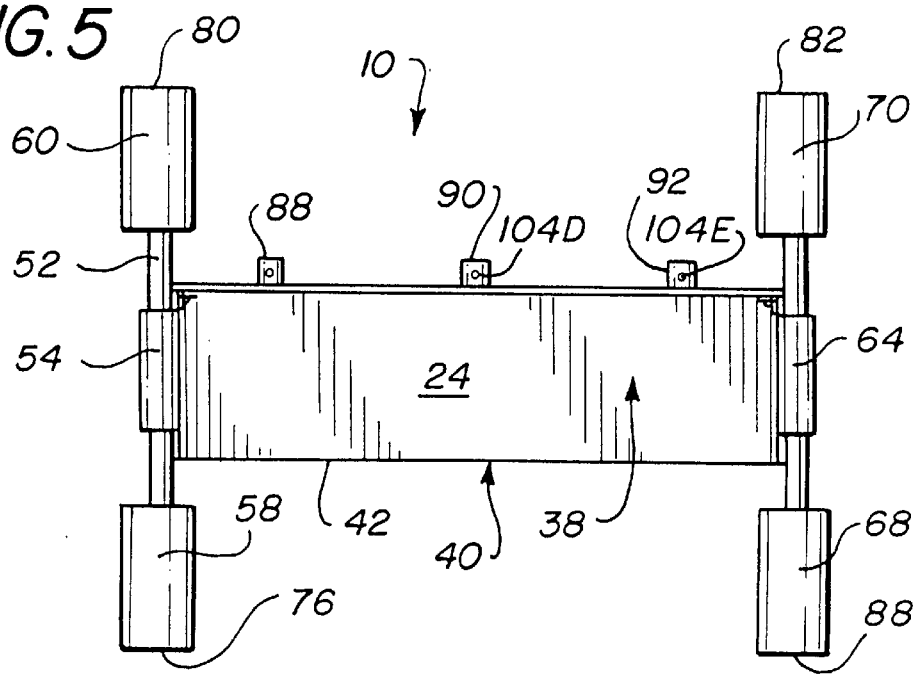
FIG. 5 is a top plan view of the FIG. 1 float platform.

As shown best in FIG. 1 and especially in FIGS. 4 and 5, the first and second flotation arms are dimensioned to extend the first and third buoyancy bodies 58, 68 to a forward buoyancy extension position beyond a first imaginary plane passing between the front edges 44, 46 of the first and second end walls 26, 30 and the front edge 42 of the base platform 24. In the forward buoyancy extension position, a forward edge 76 of the first buoyancy body and a forward edge 78 of the third buoyancy body are each a shortest distance away from the first imaginary plane that is greater than a shortest distance between the front edge 42 and the back edge 36 of the base platform 24. The forward edges 76, 78 of the first and second buoyancy bodies 58, 68 are points on the first and second buoyancy bodies 58, 68 that are a farthest distance on the buoyancy bodies from the first and second struts 52, 62.

The first and second flotation arms 48, 50 may be similarly dimensioned to extend the second and fourth buoyancy bodies 60, 70 to a backward buoyancy extension position beyond a second imaginary plane parallel to and passing through the back wall 34 of the frame 22. In the backward buoyancy extension position, a backward edge 80 of the second buoyancy body 60 and a backward edge 82 of the fourth buoyancy body 70 are each a shortest distance from the second imaginary plane that is greater then a shortest distance between the front edge 42 and back edge 36 of the base platform 24. The backward edges 80, 82 of the second and fourth buoyancy bodies 60, 70 are points on the second and fourth bodies that are a farthest distance on the buoyancy bodies from the forward edges 76, 78. By positioning the first and third buoyancy bodies 58, 68 in the forward buoyancy extension position and the second and fourth buoyancy bodies 60, 70 in the backward buoyancy extension position, the float platform 12 achieves enhanced stability that substantially resists dipping of the front edge 42 of the base platform 24 toward the bottom surface 14 of the pool 12 when a user standing in the user support area 38 adjacent the front edge 42 dives into the pool 12 water through the entry-exit 40, or when a user enters the support area 38 through the entry-exit 40.

The frame 22 may be an integral structure or preferably the frame may be easily disassembled for ease of movement and storage, wherein the frame 22 includes securing means for adjustably securing the base platform 24 to the first and second end walls 26, 30 and/or to the back wall 34. As best shown in FIG. 2, the securing means may include any of a variety of known structures for fastening a plurality of planar surfaces to each other, such as a common rod, slot and lock pin arrangement shown in FIG. 2. The base platform securing means seen in FIG. 2 includes a front end wall rod 84, and a back end wall rod 86 secured under and supporting the base platform 24, and first, second and third back wall rods 88, 90, 92 also under and supporting the base platform 24. The front end wall rod 84 and the back end wall rod 86 are dimensioned to extend beyond the first edge 28 of base platform to be secured respectively within a lower front slot 94 and lower back slot 95 of the first end wall 26 and into a lower front slot 96 and a lower back slot 97 of the second end wall 30.

The first, second and third back wall rods 88, 90, 92 are likewise dimensioned to pass beyond the back edge 36 of the base platform 24 and be secured respectively within a first lower slot 98, a second lower slot 100 and a third lower slot 102. The front and back end wall rods 84, 86 and the first, second and third back wall rods 88, 90, 92 are readily secured with the aforesaid slots of the first and second end walls 26, 30 and back wall 34 by standard locking pins 104A, 104B, 104C, 104D, 104E, 104F and 104G., as shown in FIG. 2, removably secured to the ends of the rods in a well-known manner.

If the front and back end wall rods 84, 86 and the first, second and third back wall rods 88, 90, 92 are secured within the described lower slots 94, 95, 96, 97, 98, 100, 102 of the first and second end walls 26, 30 and back wall, the frame is then disposed in a swim-training mode, wherein a shortest distance from the user support area 38 to the top edges 56, 66 of either the first or second end walls is about 2.5 feet. That distance best accommodates young children so that they have adequate exposure of their heads and shoulders above the surface of the water 20 to minimize any security problems, while positioning the user support area 38 at a sufficient depth to facilitate quick transitions from standing to swimming.

The front and back end wall rods 84, 86 and the first, second and third back wall rods 88, 90, 92 may alternatively be secured within an upper front slot 106, upper back slot 108 of the first end wall 26, a first upper slot 110, second upper slot 112, and third upper slot 114 of the back wall 34, and an upper front slot 116 and upper back slot 118 of the second end wall 30. In that disposition of the rods 84, 86, 88, 90, 92 the frame is disposed in a therapy mode, wherein a shortest distance from the user support area 38 to the top edges 56, 66 of either the first or second end walls is about 1.5 feet. That distance enables those seeking to benefit from non-swimming aquatic exercises ample room to submerge their legs and most of their arms while sitting on the user support area 38 so that their legs extend through the entry-exit 40 of the frame 22 to facilitate simultaneous kicking movements and arm motions with virtually no risk of joint injury or any aquatic hazard to the user. The float platform 10 may be readily adjusted from the swim-training mode to the therapy mode while remaining within the pool as an instructor (not shown) progress from a swimming to a therapy class. The float platform 10 may also be used in the therapy mode for especially short, young swimmers thereby expanding the capacity of the instructor to larger numbers of students.

After using the float platform 12 for swim instruction or non-swim aquatic therapy, an instructor may simply remove the locking pins 104A–104G and pivot the first and second end walls 26, 30 away from the base platform 24. The first and second end walls 26, 30 may be secured to the back wall 34 by hinge means for pivoting the end walls toward and away from the back wall 34, including know hinge mechanisms, such as a first lower hinge 120 and a first upper hinge 122 secured between the first end wall 26 and back wall 34, and a second lower hinge 124 and a second upper hinge 126 secured between the second end wall 30 and the back wall 34. The first and second flotation arms 48, 50 may be removed from the first and second strut hooks 54, 64 of the end walls. The base platform 24 may then be removed from the end walls 26, 30 and the back wall 34. The end walls 26, 30 may then be pivoted into the back wall 34 as indicated by first directional arrow 128 and second directional arrow 130 shown in FIG. 2 to collapse the end walls and back wall into a compact, floating, flat component.

After removing the back wall 34 and pivotally secured end walls 26, 30, the base platform 24 and first and second flotation arms 48, 50 from the pool 12, the base platform 24 may be stacked on top of the back and end walls, and the flotation arms 48, 50 stacked on top of or next to that stack for convenient storage near the pool with other collapsed float platforms (not shown), or for storage in the back of a "mini-van" or "sport utility vehicle" for ease of movement to an additional swim training facility.

While the float platform 10 of the present invention may be of any convenient size and shape (e.g., having non-linear end and back walls), it has been found that a preferred size is having a length of the base platform 24 from the first 26 to the second end wall 30 that is about 6–8 feet, and a preferred depth of the base platform 24 from its front edge 42 to its back edge 36 is about 2 feet. If the length of the user support area 38 and base platform is about 8 feet and the depth is about 2 feet, the user support area 38 is large enough to support 4 young swimmers that should average no more than about 125 pounds each for a total of about 500 pounds. The frame 22 of the float platform 10 is preferably structured to have at least a "zero buoyancy", meaning it needs no additional buoyancy to support itself. It is generally known in personal flotation device art that average weight adults of about 175 pounds need between 8–12 pounds of buoyancy to support their heads above water in an emergency, such as with a vest or circular ring buoy personal flotation device. Therefore, 12 pounds of buoyancy would support shoulders and head of a 125 pound child above water. To support four 125 pound children at one time about 48 pounds of buoyancy would be needed. Therefore it has been determined that when each of the four buoyancy bodies 58, 60, 68, 70 have 12 to 15 pounds of buoyancy, the float platform 10 supports such a maximum load of 500 pounds with substantial stability and with the users having their shoulders necks and heads comfortably above water. Because the size of the float platform 12 may vary, it has been further determined that for maximum comfort and safety, each user should have about four square feet of the user support area 38, which for convenience will be characterized as one user unit of the user support area. Consequently, a preferred embodiment of the float platform 10 includes the first and second flotation arms 48, 50 having a total buoyancy capacity of 12–15 pounds of buoyancy per user unit of the user support area. For example, if the base platform 24 was 6 feet long by 2 feet wide, the user support area 38 would have an adequate area for 3 user units, and the first and second flotation arms 48, 50 would have to have a total buoyancy capacity of 36–45 pounds, which could be distributed equally between the four buoyancy bodies 58, 60, 68, 70.

In use of the float platform 10 having, for example, three user units of user support area 38 in the swim-training mode, the float platform 10 may be readily assembled by a swim instructor within a swim facility by reversing the sequence described above. Several of the float platforms may be placed in the pool near the pool upper edge 18. The float platform 10 may include one or more anchor tie means for securing the platform 10 to the edge 18 of the pool or to lane lines (not shown) common to competition pools that separate swimming lanes within the pool. For example, in FIG. 1, a first anchor tie 132 is secured to the strut 52 of the first flotation arm 48 and tied to a first pool cleat 134 on the edge 18 of the pool, while a second anchor tie 136 is secured to the strut 62 of the second flotation arm 50 and a second pool cleat 138 on the pool edge 18. In a similar manner, a plurality of float platforms could be secured along an edge of a pool and/or along a lane line to facilitate full utilization of the pool for swim training and aquatic therapy. The instructor then permits three young swimmers to climb through the entry-exit 40 onto the user support area 38. After discussing strokes and showing examples of stroke technique, the instructor could next instruct the students to dive or swim through the entry-exit 40 for a few strokes, and to then return to the float platform 10. The float platform 10 affords the children an island of security within an otherwise intimidating swim facility, and also provides a superior training platform for instruction than either the edge 18 or bottom surface 14 of a pool. By being able to dive through the entry-exit 40, the young swimmers obtain momentum beneficial to learning stroke technique, without risks inherent in leaving the pool 12 to dive back into the water from above the edge 18. It is difficult for a 3–4 foot tall child to initiate a stroke from a standing position in a 3 foot pool, or from a position hanging onto edge 18 of the pool 12. The float platform dramatically facilitates training by providing young swimmers with a comfortable, partially submerged user support area 38 anywhere in a pool from which to start practicing a stroke.

While the present invention has been described and illustrated with respect to a particular construction and use of the float platform 12 for aquatic instruction and therapy, it is to be understood that the present invention is not limited to the described and illustrated description. Accordingly, reference should be made primarily to the attached claims rather than the foregoing description to determine the scope of the invention.

What is claimed is:

1. A float platform for aquatic instruction and therapy of users of the platform, the float platform comprising:

a. a frame including a base platform, a first end wall secured to a first side of the base platform, a second end wall secured to a second side of the base platform opposed to the first side of the base platform, a back wall secured between the first and second end walls to a back side of the base platform so that the first and second end walls and back wall extend above the base platform and cooperate to partially surround a user support area on the base platform having an unrestricted entry-exit between the first and second end walls above a front edge of the base platform opposed to the back edge of the platform; and, b. a first flotation arm and a second flotation arm secured to the frame by fastening means for securing the flotation arms to the frame above the base platform so that the flotation arms float top edges of the first and second end walls near a surface of the water wherein the base platform is below the surface of the water, thereby enabling users on the user support area to be partially supported above a surface of the water and enabling users to readily swim into and exit the support area through the unrestricted entry-exit, wherein the fastening means includes a first strut hook defined in a the top edge of the first end wall, a second strut hook defined in the top edge of the second end wall, the first and second strut hooks each being dimensioned to define an interior having a diameter that is about the same diameter as diameters of first and second struts of the first and second flotation arms, the first and second strut hooks each also being dimensioned to define an opening to the interior that is a distance that is slightly shorter than diameters of the first and second struts so that each strut is detachably secured within an interior of each strut hook by elastic compressive forces of the hook.

2. A float platform for aquatic instruction and therapy of users of the platform, the float platform comprising:

a. a frame including a base platform, a first end wall secured to a first side of the base platform, a second end wall secured to a second side of the base platform opposed to the first side of the base platform, a back wall secured between the first and second end walls to a back side of the base platform so that the first and second end walls and back wall extend above the base platform and cooperate to partially surround a user support area on the base platform having an unrestricted entry-exit between the first and second end walls above a front edge of the base platform opposed to the back edge of the platform;

b. a first flotation arm and a second flotation arm secured to the frame by fastening means for securing the flotation arms to the frame above the base platform so that the flotation arms float topo edges of the first and second end walls near a surface of the water wherein the base platform is below the surface of the water, thereby enabling users on the user support area to be partially supported above a surface of the water and enabling users to readily swim into and exit the support area through the unrestricted entry-exit, and, c. wherein the frame includes securing means for adjustably securing the base platform to the first and second end walls and to the back wall.

3. The float platform of claim 2, wherein the securing means comprises a plurality of rods extending from the base platform, at least one lower slot in the first and in the second end walls and in the back wall dimensioned and positioned to cooperatively receive and secure the rods to dispose the frame in a swim-training mode, and at least one upper slot in the first and in the second end walls and in the back wall above the lower slots and closer to the top edges of the end walls than the lower slots, the upper slots being dimensioned and positioned to cooperatively receive and secure the rods to alternatively dispose the frame in a therapy mode.

4. The float platform of claim 3, wherein a shortest distance between the base platform and the top edges of the first or second end walls in the swim-training mode is about two and one-half feet, and wherein a shortest distance between the base platform and the top edges of the first or second end walls in the therapy mode is about one and one-half feet.

5. The float platform of claim 1, wherein the first and second flotation arms have a total buoyancy capacity of between twelve to fifteen pounds per user unit of the user support area, wherein a user unit is about four square feet of the user support area.

6. The float platform of claim 2, wherein the first and second end walls are secured to the back wall by hinge means for pivoting the first and second end walls toward and away from the back wall.

7. A float platform for aquatic instruction and therapy of users of the platform, the float platform comprising:

a. a frame including a base platform, a first end wall secured to a first side of the base platform, a second end wall secured to a second side of the base platform opposed to the first side of the base platform, a back wall secured between the first and second end walls to a back side of the base platform so that the first and second end walls and back wall extend above the base platform and cooperate to partially surround a user support area on the base platform having an unrestricted entry-exit between the first and second end walls above a front edge of the base platform opposed to the back edge of the platform; and, b. a first flotation arm having a first buoyancy body and a second buoyancy body secured to opposed ends of a first strut, and a second flotation arm having a third buoyancy body and a fourth buoyancy body secured to opposed ends of a second strut, the first and second struts being detachably secured to the frame above the base platform so that the flotation arms float top edges of the first and second end walls near a surface of the water wherein the base platform is below the surface of the water, thereby enabling users on the user support area to be partially supported above a surface of the water and enabling users to readily swim into and exit the support area through the unrestricted entry-exit.

8. The float platform of claim 7, wherein the first and second flotation arms are dimensioned to extend the first and third buoyancy bodies to a forward buoyancy extension position beyond a first plane passing between front edges of the first and second end walls and the base platform so that forward edges of the first and third buoyancy bodies are each a shortest distance from the first plane that is greater than a shortest distance between a front edge and back edge of the base platform, and the first and second flotation arms are dimensioned to extend the second and fourth buoyancy bodies to a backward buoyancy extension position beyond a second plane parallel to and passing through the back wall of the frame, so that backward edges of the second and fourth buoyancy bodies are each a shortest distance from the second plane that is greater than the shortest distance between the front edge and back edge of the base platform.

9. The float platform of claim 8, wherein the first and second flotation arms have a total buoyancy capacity of between twelve to fifteen pounds per user unit of the user support area, wherein the user unit is about four square feet of the user support area.

10. The float platform of claim 9, wherein the frame includes securing means for adjustably securing the base platform to the first and second end walls and to the back wall.

11. The float platform of claim 10, wherein the securing means comprises a plurality of rods extending from the base platform, at least one lower slot in the first and in the second end walls and in the back wall dimensioned and positioned to cooperatively receive and secure the rods to dispose the frame in a swim-training mode, and at least one upper slot in the first and in the second end walls and in the back wall above the lower slots and closer to the top edges of the end walls than the lower slots, the upper slots being dimensioned and positioned to cooperatively receive and secure the rods to alternatively dispose the frame in a therapy mode.

12. The float platform of claim 11, wherein a shortest distance between the base platform and the top edges of the first or second end walls in the swim-training mode is about two and one half-feet, and wherein a shortest distance between the base platform and the top edges of the first or second end walls in the therapy mode is about one and one-half feet.

13. The float platform of claim 12, wherein the first and second end walls are secured to the back wall by hinge means for pivoting the first and second end walls toward and away from the back wall.

14. A float platform for aquatic instruction and therapy of users of the platform, the float platform comprising:

a. a frame including a base platform, a first end wall secured to a first side of the base platform, a second end wall secured to a second side of the base platform opposed to the first side of the base platform, a back wall secured between the first and second end walls to a back side of the base platform so that the first and second end walls and back wall extend above the base platform and cooperate to partially surround a user support area on the base platform having an unrestricted entry-exit between the first and second end walls above a front edge of the base platform opposed to the back edge of the platform; and, b. a first flotation arm having a first buoyancy body and a second buoyancy body secured to opposed ends of a first strut, and a second flotation arm having a third buoyancy body and a fourth buoyancy body secured to opposed ends of a second strut, the first and second struts being secured to the frame above the base platform so that the flotation arms float top edges of the first and second end walls near a surface of the water wherein the base platform is below the surface of the water, thereby enabling users on the user support area to be partially supported above a surface of the water and enabling users to readily swim into and exit the support area through the unrestricted entry-exit, and wherein the first and second flotation arms are dimensioned to extend the first and third buoyancy bodies to a forward buoyancy extension position beyond a first plane passing between front edges of the first and second end walls and the base platform so that forward edges of the first and third buoyancy bodies are each a shortest distance from the first plane that is greater than a shortest distance between a front edge and back edge of the base platform.

15. The float platform of claim 14, wherein the frame includes securing means for adjustably securing the base platform to the first and second end walls and to the back wall.

16. The float platform of claim 15, wherein the securing means comprises a plurality of rods extending from the base platform, at least one lower slot in the first and in the second end walls and in the back wall dimensioned and positioned to cooperatively receive and secure the rods to dispose the frame in a swim-training mode, and at least one upper slot in the first and in the second end walls and in the back wall above the lower slots and closer to the top edges of the end walls than the lower slots, the upper slots being dimensioned and positioned to cooperatively receive and secure the rods to alternatively dispose the frame in a therapy mode.

17. The float platform of claim 16, wherein the first and second flotation arms have a total buoyancy capacity of between twelve to fifteen pounds per user unit of the user support area, wherein the user unit is about four square feet of the user support area.

* * * * *